US005153913A

United States Patent [19]

Kandefer et al.

[11] Patent Number: 5,153,913

[45] Date of Patent: Oct. 6, 1992

[54] GENERATING SPEECH FROM DIGITALLY STORED COARTICULATED SPEECH SEGMENTS

[75] Inventors: Edward M. Kandefer, Milpitas, Calif.; James R. Mosenfelder, Bark River, Mich.

[73] Assignee: Sound Entertainment, Inc., Coraopolis, Pa.

[21] Appl. No.: 382,675

[22] PCT Filed: Oct. 7, 1988

[86] PCT No.: PCT/US88/03479

§ 371 Date: Jun. 19, 1989

§ 102(e) Date: Jun. 19, 1989

[87] PCT Pub. No.: WO89/03573

PCT Pub. Date: Apr. 20, 1989

[51] Int. Cl.[5] ..... G10L 5/01

[52] U.S. Cl. ..... 381/51; 381/52

[58] Field of Search ..... 381/51-53, 381/35, 36, 37-40; 364/513.5

[56] References Cited

U.S. PATENT DOCUMENTS

| | | | |
|---|---|---|---|
| 4,319,084 | 3/1982 | Lucchini et al. | 381/51 |
| 4,437,087 | 3/1984 | Petr | 340/347 |
| 4,672,670 | 6/1987 | Wang et al. | 381/31 |
| 4,685,135 | 8/1987 | Lin et al. | 381/52 |
| 4,691,359 | 9/1987 | Morito | 381/51 |
| 4,799,261 | 1/1989 | Lin et al. | 381/36 |
| 4,833,718 | 5/1989 | Sprague | 381/35 |

FOREIGN PATENT DOCUMENTS

WO8504747 10/1985 PCT Int'l Appl. .

OTHER PUBLICATIONS

Electronique Industrielle No. 70/1-05-1984 Synthese de la parole: presque de la HiFi!, pp. 37-42.

298 N.E.C. Research & Development, (1984), Apr., No. 73, Tokyo, Japan, SR-2000 Voice Processor and Its Applications, pp. 98-105.

IEEE Transactions on Acoustics, Speech, and Signal Processing, vol. ASSP-22, No. 5, Oct. 1974, A Multi-line Computer Voice Response System Utilizing ADPCM Coded Speech, Rosenthal et al., pp. 339-352.

*Primary Examiner*—Dale M. Shaw

*Assistant Examiner*—Michelle Doerrler

*Attorney, Agent, or Firm*—Richard V. Westerhoff

[57] ABSTRACT

Coarticulated speech segment data are extracted from spoken carrier syllables and digitally compressed for storage using adaptive differential pulse code modulation (ADPCM). Beginning seed quantization and PCM values are generated for each coarticulated speech segment and stored together with the ADPCM encoded data in a coarticulated speech segment library. ADPCM encoded data are recovered from the coarticulated speech segment library and blown back using the initial quantization and PCM seed values to reconstruct and concatenate in real time the sequence of coarticulated speech segments required by a text to speech program to generate a desired high quality spoken message. In the preferred embodiment of the invention, the coarticulated speech segments are diphones.

23 Claims, 12 Drawing Sheets

GENERATING SPEECH FROM DIGITALLY STORED COARTICULATED SPEECH SEGMENTS

Background of the Invention

1. Field of the Invention

This invention relates to a method and apparatus for generating speech from a library of prerecorded, digitally stored, spoken, coarticulated speech segments and includes generating such speech by expanding and connecting in real time, digital time domain compressed coarticulated speech segment data.

2. Background Information

A great deal of effort has been expended in attempts to artificially generate speech. By artificially generating speech it is meant for the purposes of this discussion selecting from a library of sounds a desired sequence of utterances to produce a desired message. The sounds can be recorded human sounds or synthesized sounds. In the latter case, the characteristic sounds of a particular language are analyzed and waveforms of the dominant frequencies, known as formants, are generated to synthesize the sound.

The sounds, whether recorded human sounds or synthesized sounds, from which speech is artificially generated can, of course be complete words in the given language. Such an approach, however, produces speech with a limited vocabulary capability or requires a tremendous amount of data storage space.

In order to more efficiently generate speech, systems have been devised which store phonemes, which are the smallest units of speech that serve to distinguish one utterance from another in a given language. These systems operate on the principle that any word may be generated through proper selection of a phoneme or a sequence of phonemes. For instance, in the English language there are approximately 40 phonemes, so that any word in the English language can be produced by a suitable combination of these 40 phonemes. However, the sound of each phoneme is affected by the phonemes which precede and succeed it in a given word. As a result, systems to date which concatenate together phonemes have been only moderately successful in generating understandable, let alone natural sounding speech.

It has long been recognized that diphones offer the possibility of generating realistic sounding speech. Diphones span two phonemes and thus take into account the effect on each phoneme of the surrounding phonemes. The basic number of diphones then in a given language is equal to the square of the number of phonemes less any phoneme pairs which are never used in that language. In the English language this accounts for somewhat less than 1600 diphones. However, in some instances a phoneme is affected by other phonemes in addition to those adjacent, or there is a blending of adjacent phonemes. Thus, a library of diphones for the English language may include up to about 1700 entries to accommodate all the special cases.

The diphone is referred to as a coarticulated speech segment since it is composed of smaller speech segments, phonemes, which are uttered together to produce a unique sound. Larger coarticulated speech segments than the diphone, include syllables, demisyllable (two syllables), words and phrases. As used throughout, the term coarticulated speech segment is meant to encompass all such speech.

While it may be possible to construct a speech generator which produces a desired message from whole words or phases stored in analog form, access times required for generating real time speech from phonemes, diphones or syllables must be implemented using digital storage techniques. However, the complex wave forms of speech require a great deal of data storage to produce quality speech. Digital storage of words and phrases also provides better access times, but requires even greater storage capacity.

In digitally storing sounds, the desired waveform is pulse code modulated by periodically sampling waveform amplitude. As is well known, the bandwidth of the digital signal is only one half the sampling rate. Thus for a bandwidth of 4 KHz a sampling rate of 8 KHz is required. Furthermore, because of the wide dynamic range of speech signals, quality reproduction requires that each sample have a sufficient number of bits to provide adequate resolution of waveform amplitude. The massive amount of data which must be stored in order to adequately reproduce a library of diphones has been an obstacle to a practical speech generation system based on diphones. Another difficulty in producing speech from a library of diphones is connecting the diphones so as to produce natural sounding transitions. The amplitude at the beginning or end of a diphone in the middle of a word may be changing at a very high rate. If the transition between diphones is not effected smoothly, a very noticeable bump is created which seriously degrades the quality of the speech generated.

Attempts have been made to reduce the amount of digital data required to store a library of sounds for speech generation systems. One such approach is linear predictive coding in which a set of rules is applied to reduce the number of data bits required to reproduce a given waveform. While this technique substantially reduces the data storage space required, the speech produced is not very natural sounding.

Another approach to reducing the amount of digital data required for storage of a library of sounds is represented by the various methods of time domain compression of the pulse code modulated signal. These techniques include, for instance, delta modulation, differential pulse code modulation, and adaptive differential pulse code modulation (ADPCM). In these techniques, only the differential or change from the previous sample point is digitally stored. By adding this differential to the waveform amplitude at the previous point, a good approximation of the high resolution value of the waveform at any sample point can be obtained with fewer bits of data. Due to the wide dynamic range of speech waveforms, the change in amplitude between samples can vary significantly. The ADPCM technique of time domain compression adjusts the size of the steps between samples based upon the rate of change of the waveform at the previous sample point. This results in the generation of a quantitization number which represents the size of the step under consideration.

In all of these systems using compressed time domain signals, a running value of the amplitude of the waveform is maintained and the magnitude of the next step is added to it to obtain the new value of the waveform. Thus in these systems the amplitude of the waveform starts from zero and builds up. Since there is a maximum size to each step, a number of steps are required to reach a high amplitude. Thus these systems work well in starting with a signal such as a beginning utterance which begins at zero amplitude and builds. However, for joining coarticulated speech segments such as diphones in the middle of words or phases where the signal is already at a high amplitude, these time domain compression techniques do not generate a signal which accurately tracks the transitions between the coarticulated speech segments resulting in bumps which clearly degrade the quality of the reproduced speech.

There is therefore still a need for a method and apparatus for producing speech from digitally stored diphones which has a bandwidth and bit resolution adequate to generate quality speech. There is also a need for a method and apparatus for producing speech from digitally stored coarticulated speech segments which can join the stored coarticulated speech segments in real time with the smooth transitions required for quality speech. There is an additional need for such a method and apparatus which reduces the amount of storage space required for the coarticulated speech segment library.

SUMMARY OF THE INVENTION

These and other needs are met by the invention in which digital data samples representing beginning, middle and ending coarticulated speech sounds are extracted from digitally recorded spoken carrier syllables in which the coarticulated speech segments are embedded. The carrier syllables are pulse code modulated at least 3, and preferably 4 KHz. The data samples representing the coarticulated speech segments are cut from the carrier syllables pulse code modulated (PCM) data samples at a common location in each coarticulated speech segment waveform; preferably substantially at the data sample closest to a zero crossing with each waveform traveling in the same direction.

The coarticulated speech segment data samples are digitally stored in a coarticulated speech segment library and are recovered from storage by a text to speech program in a sequence selected to generate a desired message. The recovered coarticulated speech segments are concatenated in the selected sequence directly, in real time. The concatenated coarticulated speech segment data is applied to sound generating means to acoustically produce the desired message.

Preferably, the PCM data samples representing the extracted coarticulated speech segment sounds are time domain compressed to reduce the storage space required. The recovered data is then re-expanded to reconstruct the PCM data. Data compression includes generating a seed quantizer for the first data sample in each coarticulated speech segment which is stored along with the compressed data. Reconstruction of the PCM data from the stored compressed data is initiated by the seed quantizer. The uncompressed PCM data for the first data sample in each coarticulated speech segment is also stored as a seed for the reconstructed PCM value of the diphone. This PCM seed is used as the PCM value of the first data sample in the reconstructed waveform. The quantizer seed is used with the compressed data for the second data sample to determine the reconstructed PCM value of the second data sample as an incremental change from the seed PCM value.

In the preferred form of the invention, adaptive differential pulse code modulation (ADPCM) is used to compress the PCM data samples. Thus, the quantizer varies from sample to sample; however, since the coarticulated speech segments to be joined share a common speech segment at their juncture, and are cut from carrier syllables selected to provide similar waveforms at the juncture, the seed quantizer for a middle coarticulated speech segment is the same or substantially the same as the quantizer for the last sample of the preceding coarticulated speech segment, and a smooth transition is achieved without the need for blending or other means of interpolation.

As one aspect of the invention, the seed quantizer for each extracted coarticulated speech segment is determined by an interactive process which includes assuming a quantizer for the first data sample in the coarticulated speech segment. A selected number, which may include all, of the data samples are ADPCM encoded using the assumed quantizer as the initial quantizer. The PCM data is then reconstructed from the ADPCM data and compared with the original PCM data for the selected samples. The process is repeated for other assumed values of the quantizer for the first data sample, with the quantizer which produces the best match being selected for storage as the seed quantizer for initiating compression and subsequent reconstruction of the selected coarticulated speech segment.

The invention encompasses both the method and apparatus for generating speech from stored digital coarticulated speech segment data and is particularly suitable generating quality speech using diphones as the coarticulated speech segments.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1A:
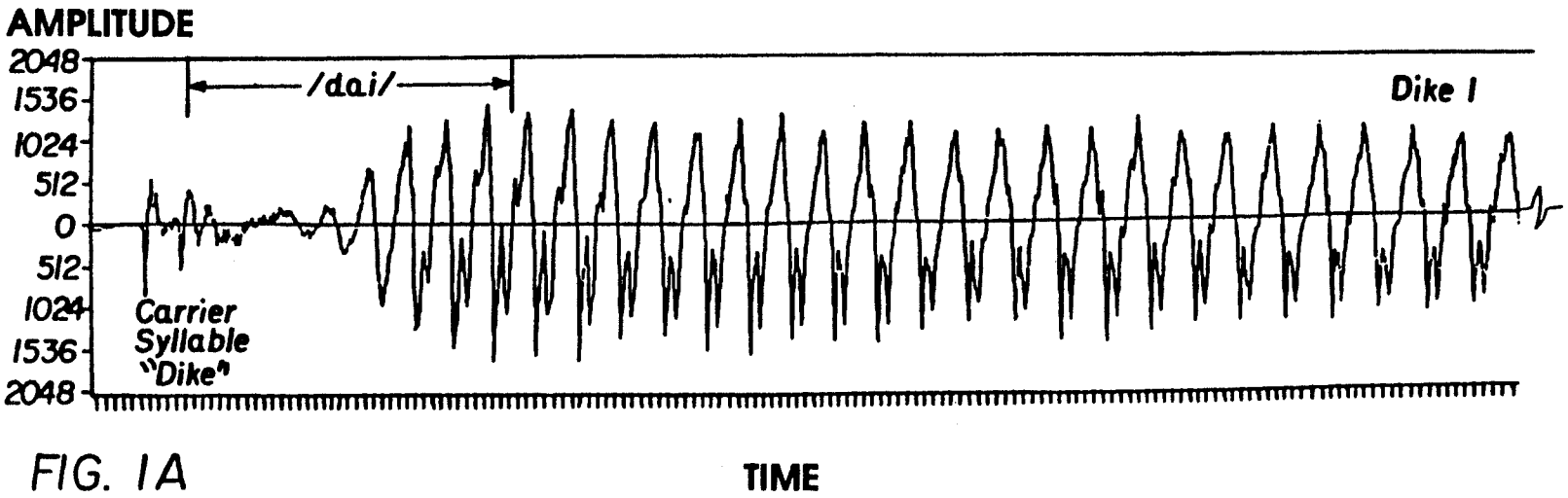
FIGS. 1*a* and *b* illustrate an embodiment of the invention utilizing diphones as the coarticulated segment of speech and when joined end to end constitute a waveform diagram of a carrier syllable in which a selected diphone is embedded.

In accordance with the invention, speech is generated from coarticulated speech segments extracted from human speech. In the preferred embodiment of the invention to be described in detail, the coarticulated speech segments are diphones. As discussed previously, diphones are sounds which bridge phonemes. In other words, they contain a portion of two, or in some cases more, phonemes, with phonemes being the smallest units of sound which form utterances in a given language. The invention will be described as applied to the English language, but it will be understood by those skilled in the art that it can be applied to any language, and indeed, any dialect.

As mentioned above, there are about 40 phonemes in the English language. Our library contains about 1650 diphones, including all possible combinations used in the English language of each of the 40 phonemes taken two at a time plus additional diphones representing blended consonants and sounds affected by more than just adjacent phonemes. Such a library of diphones which uses the International Phonetic Alphabet symbolization is well known to a linguist. The number and selection of special diphones in addition to those generated from pairs of the phonemes in the International Phonetic Alphabet is a matter of choice taking into consideration the precision with which it is desired to produce some of the more complex sounds.

The library of diphones includes sounds which can occur at the beginning, the middle, or the end of a word, or utterance in the instance where words may be run together. Thus, recordings were made with the phonemes occurring in each of the three locations.

In accordance with known techniques, the diphones were embedded for recording in carrier words, or perhaps more appropriately carrier syllables, in that for the most part, the carriers were not words in the English language. Linguists are skilled in selecting carrier syllables which produce the desired utterance of the embedded diphone.

The carrier syllables are spoken sequentially for recording, preferably by a trained linguist and in one session so that the frequency of corresponding portions of diphones to be joined are as nearly uniform as possible. While it is desirable to maintain a constant loudness as an aid to achieving uniform frequency, the amplitude of the recorded diphones can be normalized electronically.

The diphones are extracted from the recorded carrier syllables by a person, such as a linguist, who is trained in recognizing the characteristic waveforms of the diphones. The carrier syllables were recorded by a high quality analog recorder and then converted to digital signals, i.e., pulse code modulated, with twelve bit accuracy. A sampling rate of 8 KHz was selected to provide a bandwidth of 4 KHz. Such a bandwidth has proven to provide quality voice signals in digital voice transmission systems. Pulse rates down to about 6 KHz, and hence a bandwidth of 3 KHz, would provide satisfactory speech, with the quality deteriorating appreciably at lower sampling rates. Of course higher pulse rates would provide better frequency response, but any improvement in quality would, for the most part, not be appreciated and would proportionally increase the digital storage capacity required.

Figure 1B:
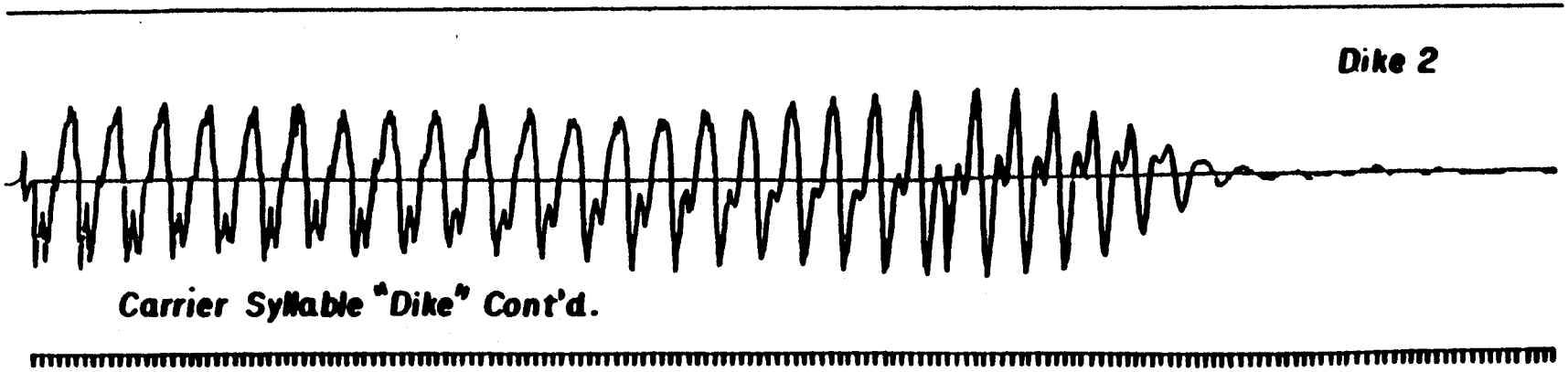

The diphones are extracted from the carrier syllables by an operator using a conventional waveform edit program which generates a visual display of the waveform. Such a display of a carrier syllable waveform containing a selected diphone is illustrated in FIGS. 1*a* and *b*. FIGS. 1*a* and *b* illustrate the waveform of the carrier syllable "dike" in which the diphone /dai/, that is the diphone bridging the phonemes middle /d/ and middle /ai/ and pronounced "dī", is embedded between two supporting diphones. The terminal portion of the carrier syllable dike which continues for approximately another 2000 samples of unvoiced sound after FIG. 1*b* has not been included, but it does not affect the embedded diphone /dai/.

All of the diphones are cut from the respective carrier syllables at a common location in the waveform. In the exemplary system, the cuts were made from the PCM data at the sample point closest to but after a zero crossing for the beginning of a diphone, and closest to but before a zero crossing for the end of a diphone, with the waveform traveling in the positive direction. This is illustrated by the extracted diphone /dai/ shown in FIG. 2 which was cut from the carrier syllable "dike" shown in FIG. 1. As indicated on FIG. 2, the PCM value of the first sample in the extracted diphone is +219 while the PCM value of the last sample is −119.

The extracted diphones were time domain compressed to reduce the volume of data to be stored. In the exemplary system, a four bit ADPCM compression was used to reduce the storage requirements from 96,000 bits per second (8 KHz sampling rate times twelve bits per sample) to 32,000 bits per second. Thus, the storage requirement for the diphone library was reduced by two thirds.

The ADPCM technique for time domain compression of a PCM signal is well known. As mentioned above, the time domain compression techniques, including ADPCM, store an encoded differential between the value of the PCM data at each sample point and a running value of the waveform calculated for the preceding point, rather then the absolute PCM value. Since speech waveforms have a wide dynamic range, small steps are required at low signal levels for accurate reproduction while at volume peaks, larger steps are adequate. ADPCM has a quantization value for determining the size of each step between samples which adapts to the characteristics of the waveform such that the value is large for large signal changes and small for small signal changes. This quantization value is a function of the rate of change of the waveform at the previous data points.

ADPCM data is encoded from PCM data in a multistep operation which includes: determining for each sample point the difference between the present PCM code value and the PCM code value reproduced for the previous sample point. Thus, $$dn = Xn(n-1) \qquad \text{Eq. 1}$$

where:

dn is the PCM code value differential

Xn is the present PCM code value

Xn−1 is the previously reproduced PCM code value.

The quantization value is then determine as follows:

$$\Delta n = \Delta n - 1 \times 1.1^{M(L_{n-1})} \qquad \text{Eq. 2}$$

where:

Δn is the quantization value

Δn−1 is the previous quantization value

M is a coefficient $L_{n-1}$ is the previous ADPCM code value

The quantization value adapts to the rate of change of the input waveform, based upon the previous quantization value and related to the previous step size through $L_{n-1}$. The quantization value $\Delta n$ must have minimum and maximum values to keep the size of the steps from becoming too small or too large. Values of $\Delta n$ are typically allowed to range from 16 to $16 \times 1.1^{49}$ (1552). Table I shows the values of the coefficient M which correspond to each value of $L_{n-1}$ for a 4 bit ADPCM code.

TABLE 1

VALUES OF THE COEFFICIENT M

| 4-bit case | | |
|---|---|---|
| $L_{n-1}$ | $L_{n-1}$ | $M_{(1n-1)}$ |
| 1111 | 0111 | +8 |
| 1110 | 0110 | +6 |
| 1101 | 1101 | +4 |
| 1100 | 0100 | +2 |
| 1011 | 0011 | −1 |
| 1010 | 0010 | −1 |
| 1001 | 0001 | −1 |
| 0000 | | −1 |

The ADPCM code value, $L_n$, is determined by comparing the magnitude of the PCM code value differential, dn, to the quantization value and generating a 3-bit binary number equivalent to that portion. A sign bit is added to indicate a positive or negative dn. In the case of dn being half of n, the format for Ln would be:

| MSB | 2SB | 3SB | LSB |
|---|---|---|---|
| 0 | 0 | 1 | 0 |

The most significant bit (MSB) of Ln indicates the sign of dn, 0 for plus or zero values, and 1 for minus values. The second most significant bit (2SB) compares the absolute value of dn with the quantization width $\Delta n$, resulting in a 1 if /dn/ is larger or equal, or zero if it is smaller. When this 2SB is 0, the third most significant bit (3SB) compares dn with half the quantization width, $\Delta n/2$, resulting in a 1 if /dn/ is larger or equal, or 0 if it is smaller. When the 2SB is 1, (/dn/ $-\Delta n$) is compared with $\Delta n/2$ to determine the 3SB. This bit becomes 1 if (/dn/$\Delta n$) is larger or equal, or 0 if it is smaller. The LSB is determined similarly with reference to $\Delta n/4$.

The resultant ADPCM code value contains the data required to determine the new reproduced PCM code value and contains data to set the next quantization value. This "double data compression" is the reason that 12-bit PCM data can be compressed into 4-bit data.

In the exemplary embodiment of the invention, the 12 bit PCM signals of the extracted diphones are compressed using the Adaptive Differential Pulse Code Modulation (ADPCM) technique. Since the beginnings of many of the diphones extracted from the middle or end of a carrier syllable are already at high amplitudes with large changes in signal level between samples, some way must be found for determining the ADPCM quantization value for the first cycle of each of these extracted waveforms. In accordance with the invention, the edit program calculates the quantization value for the first data sample in the extracted waveform iteratively by assuming a value, ADPCM encoding the PCM values for a selected number of samples at the beginning of the extracted diphone, such as 50 samples in the exemplary system, using the assumed quantization value for the first sample point, and then reproducing the PCM waveform from the encoded data and comparing it with the initial PCM data for those samples. The process is repeated for a number of assumed quantization values and the assumed value which best reproduces the original PCM code is selected as the initial or beginning quantization value. The data for the entire diphone is then encoded beginning with this quantization value and the beginning quantization value and beginning PCM value (actual amplitude) are stored in memory with the encoded data for the remaining sample points of the diphone. In the case of the exemplary diphone /dai/ shown in FIG. 2, the beginning quantization value, QV, is 143. Such a quantization value indicates that the waveform is changing at a modest rate at this point which is verified by the shape of the waveform at the initial sample point.

Figure 3:
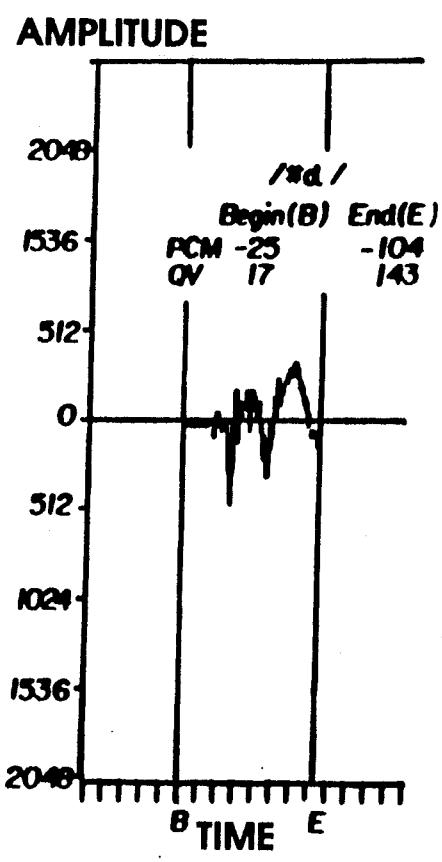
FIG. 3 is a waveform diagram of another diphone extracted from a carrier syllable which is not shown.
Figure 2:
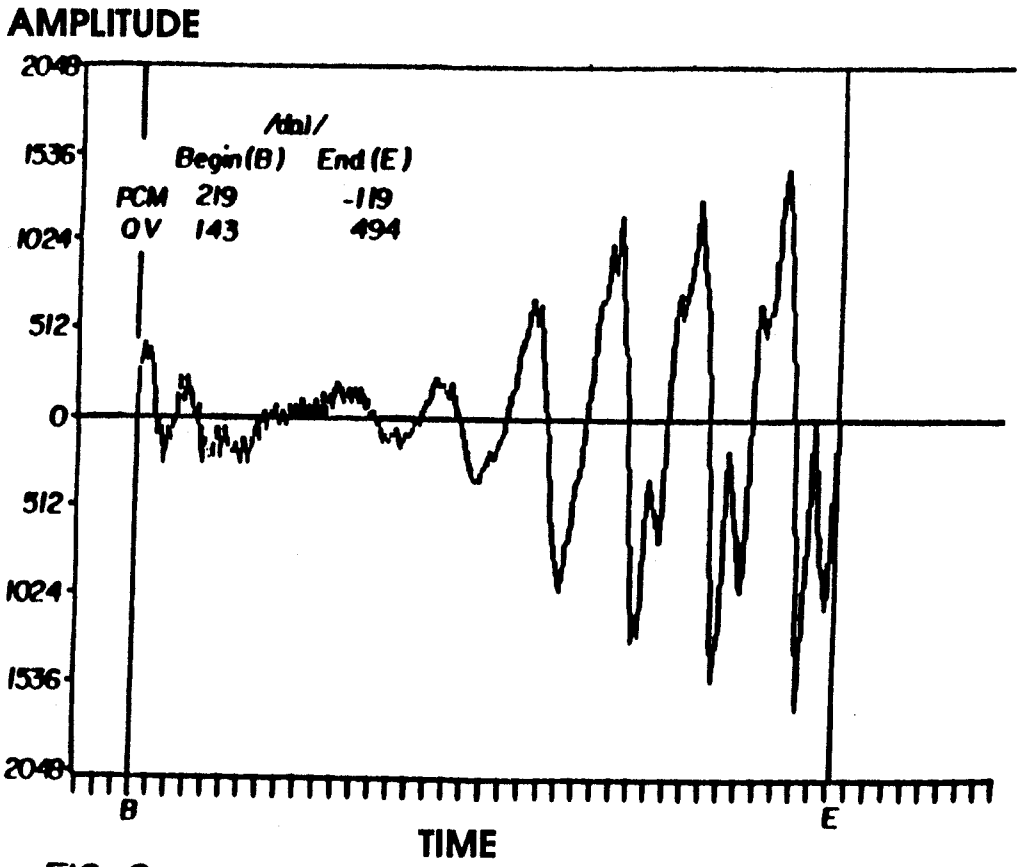
FIG. 2 is a waveform diagram in larger scale of the selected diphone extracted from the carrier syllable of FIG. 1.
Figure 4:
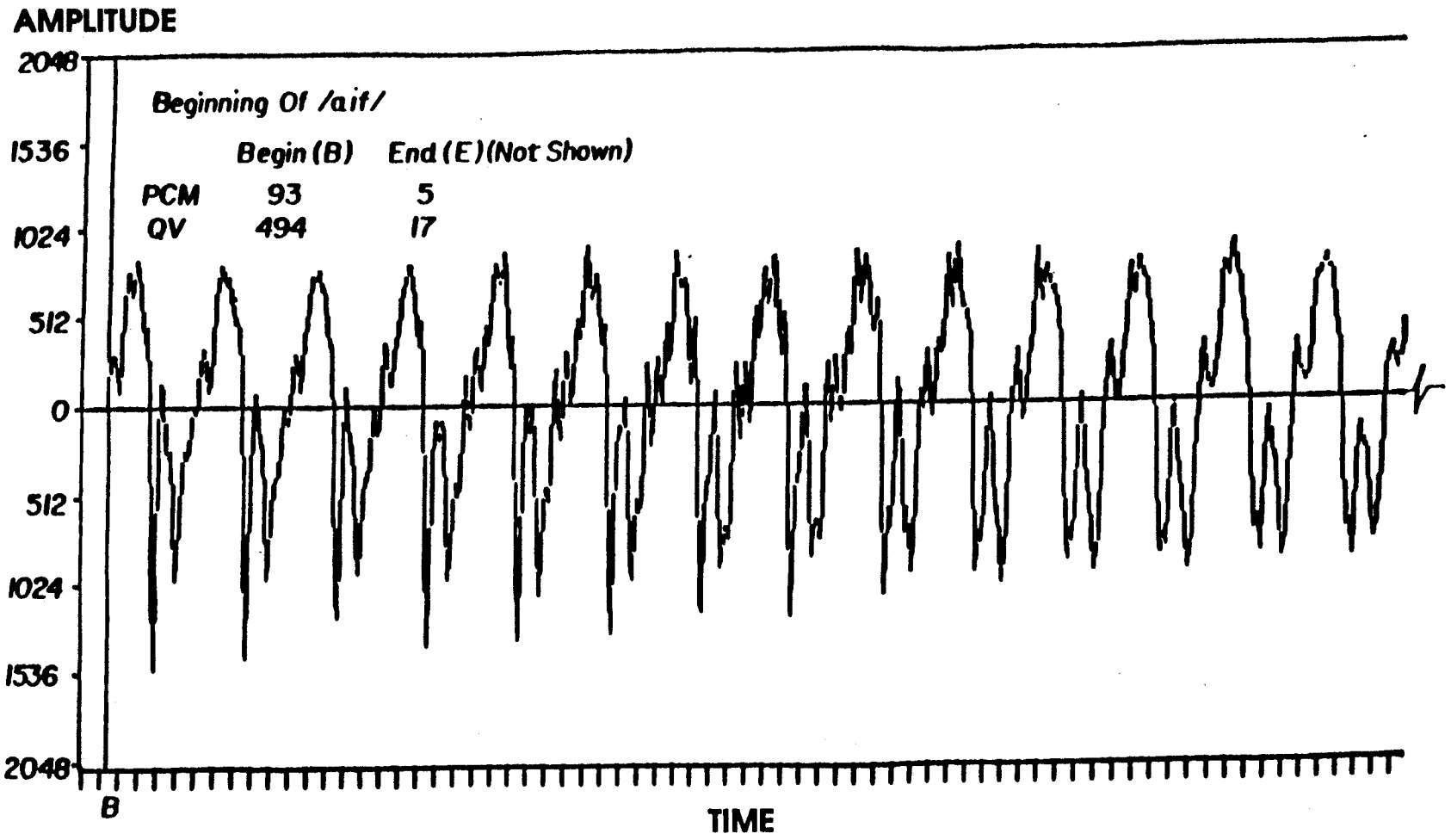
FIG. 4 is a waveform diagram of the beginning of still another extracted diphone.
Figure 5:
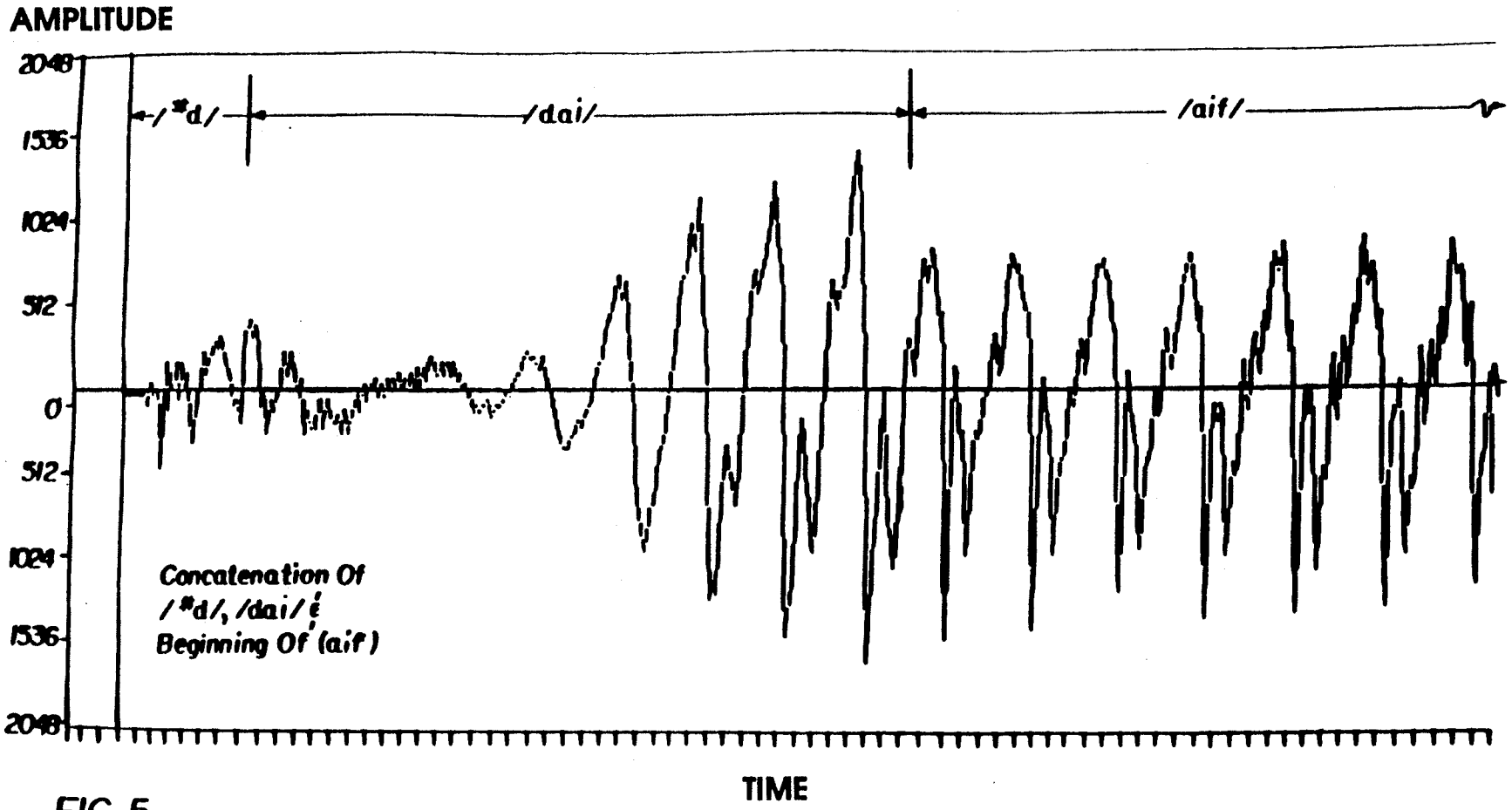
FIG. 5 is a waveform diagram illustrating the concatenation of the diphone waveforms of FIGS. 2 through 4.

A desired message is generated by concatenating or stringing together the appropriate diphone data. By way of example, FIGS. 2 through 4 illustrate the first two and the beginning of the third of the six diphones which are used to generate the word "diphone" which is illustrated in its entirety in FIG. 6. FIG. 5 shows the concatenation of the first three phonemes, beginning "d" /#d/, /dai/, and the beginning of /aif/ pronounced "if". As can be seen from FIGS. 2 through 6, the adjacent diphones share a common phoneme. For example, the second diphone /dai/, illustrated in FIG. 2, contains the phonemes /d/ and /ai/. The first phoneme /#d/, shown in FIG. 3, ends with the same phoneme as the following diphone begins with, in accordance with the principles of coarticulation. The third diphone /aif/ begins with the phoneme /ai/ as shown in FIG. 4 which is the trailing sound of the diphone immediately preceeding it. As can be senn from FIGS. 2–6, the shape of the beginning of the waveform for the second diphone closely resembles that of the end of the waveform for the first diphone, and similarly, the shape of the waveform at the end of the second diphone closely resembles that at the beginning of the third, and so on for adjacent diphones. The fourth through sixth diphones which are concatenated to generate the word "diphone", are /fo pronounced "fo", /on/ pronounced "on", and /n#/, ending n.

Figure 6A:
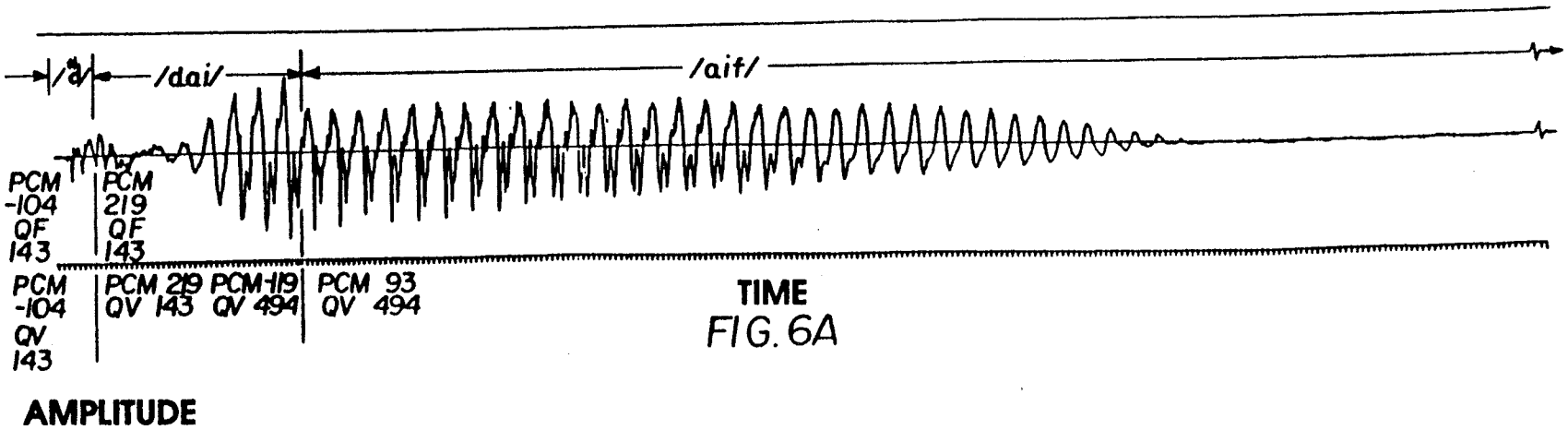
FIGS. 6*a, b* and *c* when joined end to end constitute a waveform diagram in reduced scale of an entire word generated in accordance with the invention and which includes at the beginning the diphones illustrated in FIGS. 2 through 4 and shown concatenated in FIG. 5.
Figure 6B:
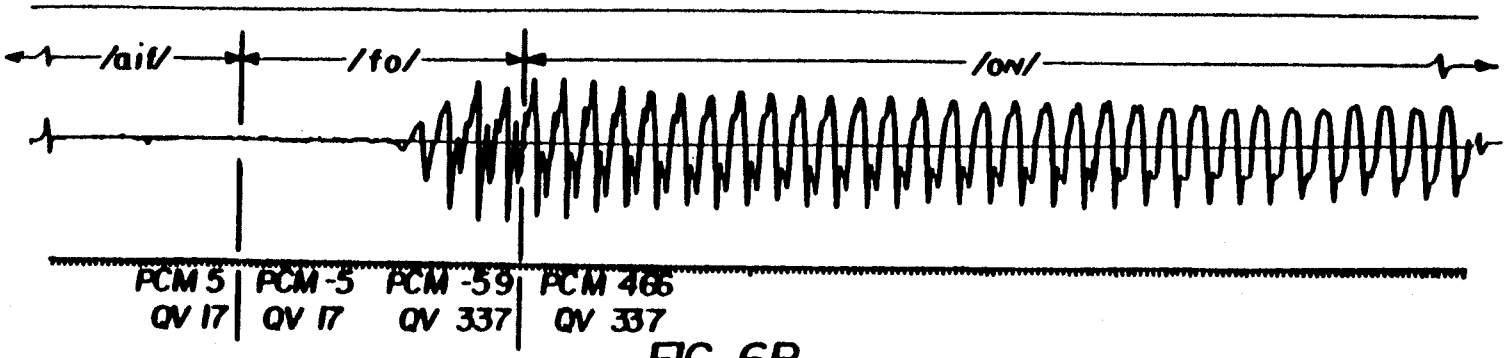
Figure 6C:
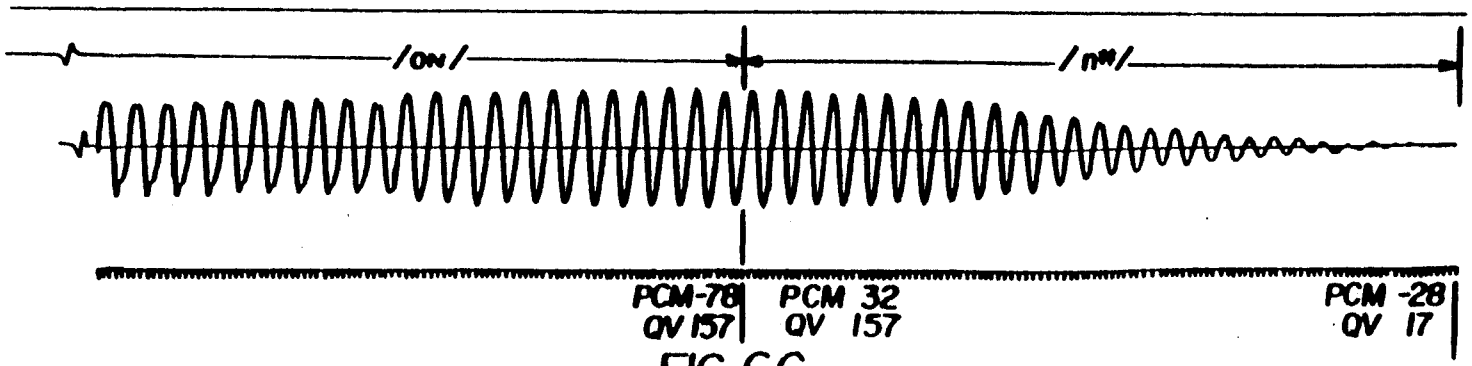

As illustrated by FIGS. 5 and 6, smooth transitions between diphones are achieved. It will be noted from the ADPCM quantization values provided on FIGS. 2–4 and 6, that the quantization value calculated from the last point in each diphone matches that stored for the first sample point of the succeeding diphone, which verifies that the two waveforms are traveling at similar rates at their juncture. The differences in the PCM values for the terminal data points in adjacent diphones are to be expected for fast moving waveforms, and any discontinuities are so slight as to be unnoticeable.

Figure 7:
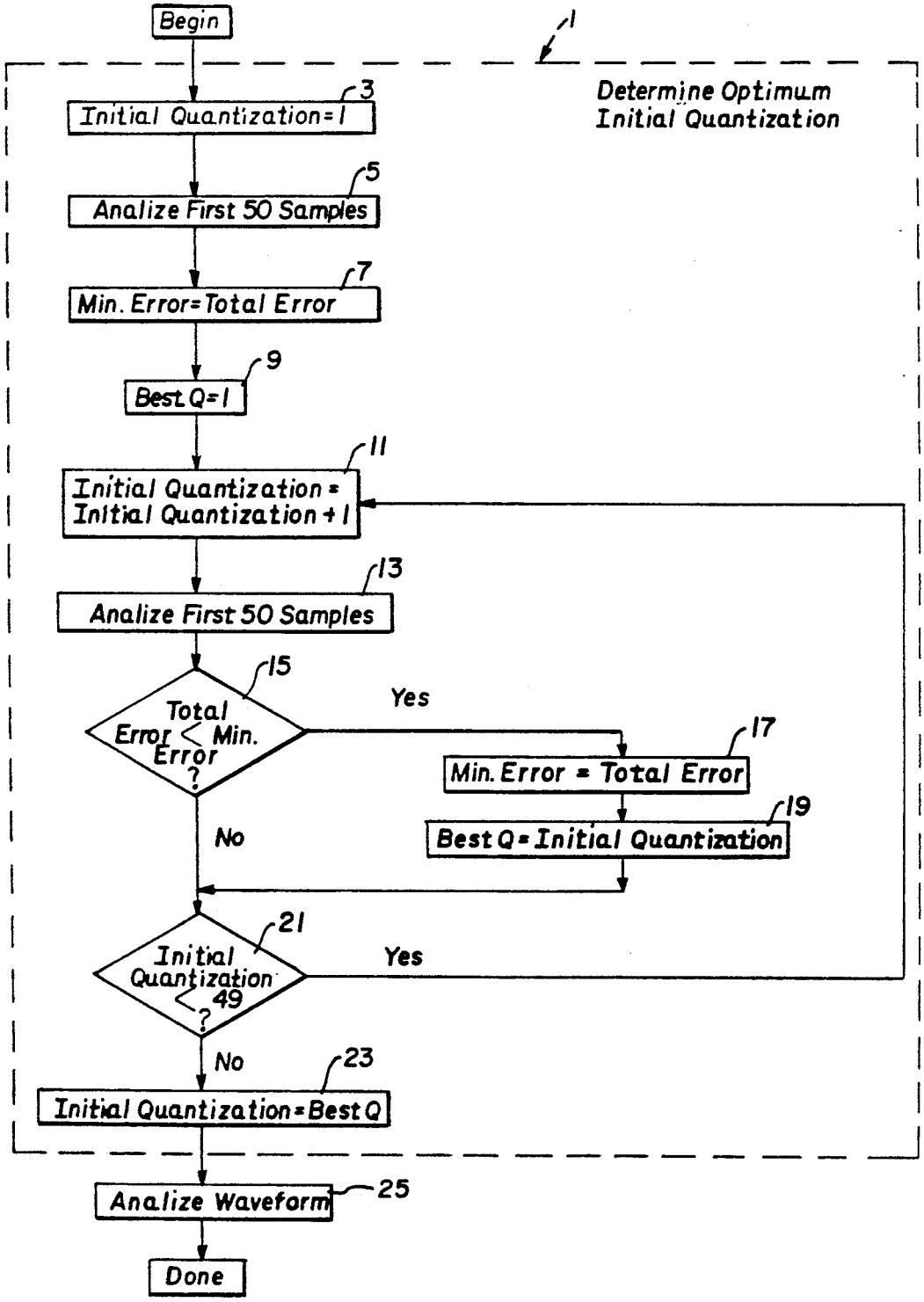
FIG. 7 is a flow diagram illustrating the program for generating a library of digitally compressed diphones in accordance with the teachings of the invention.
Figure 8A:
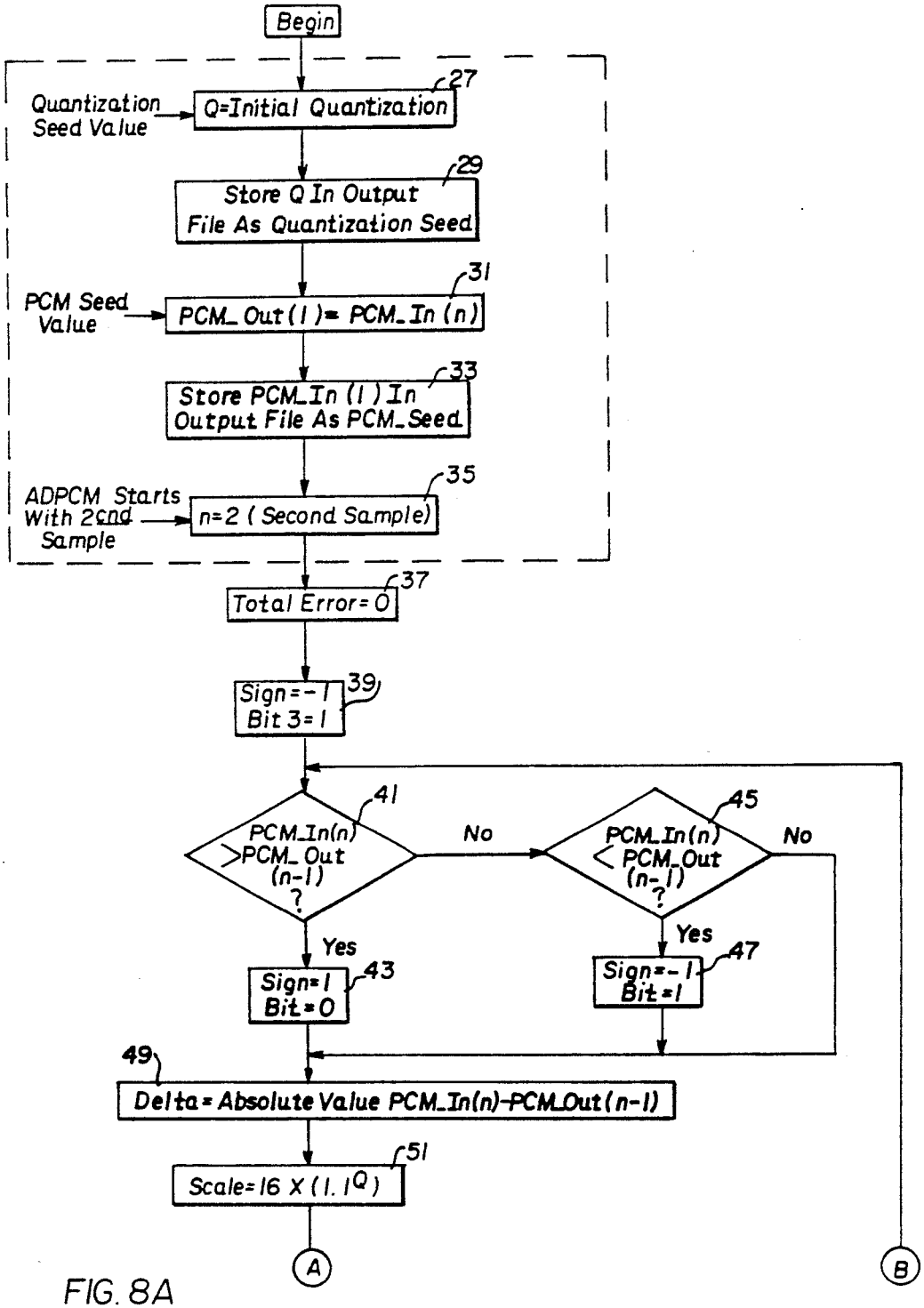
FIGS. 8*a* and *b* when joined as indicated by the tags illustrate a flow diagram of an analysis routine used in the program of FIG. 7.
Figure 8B:
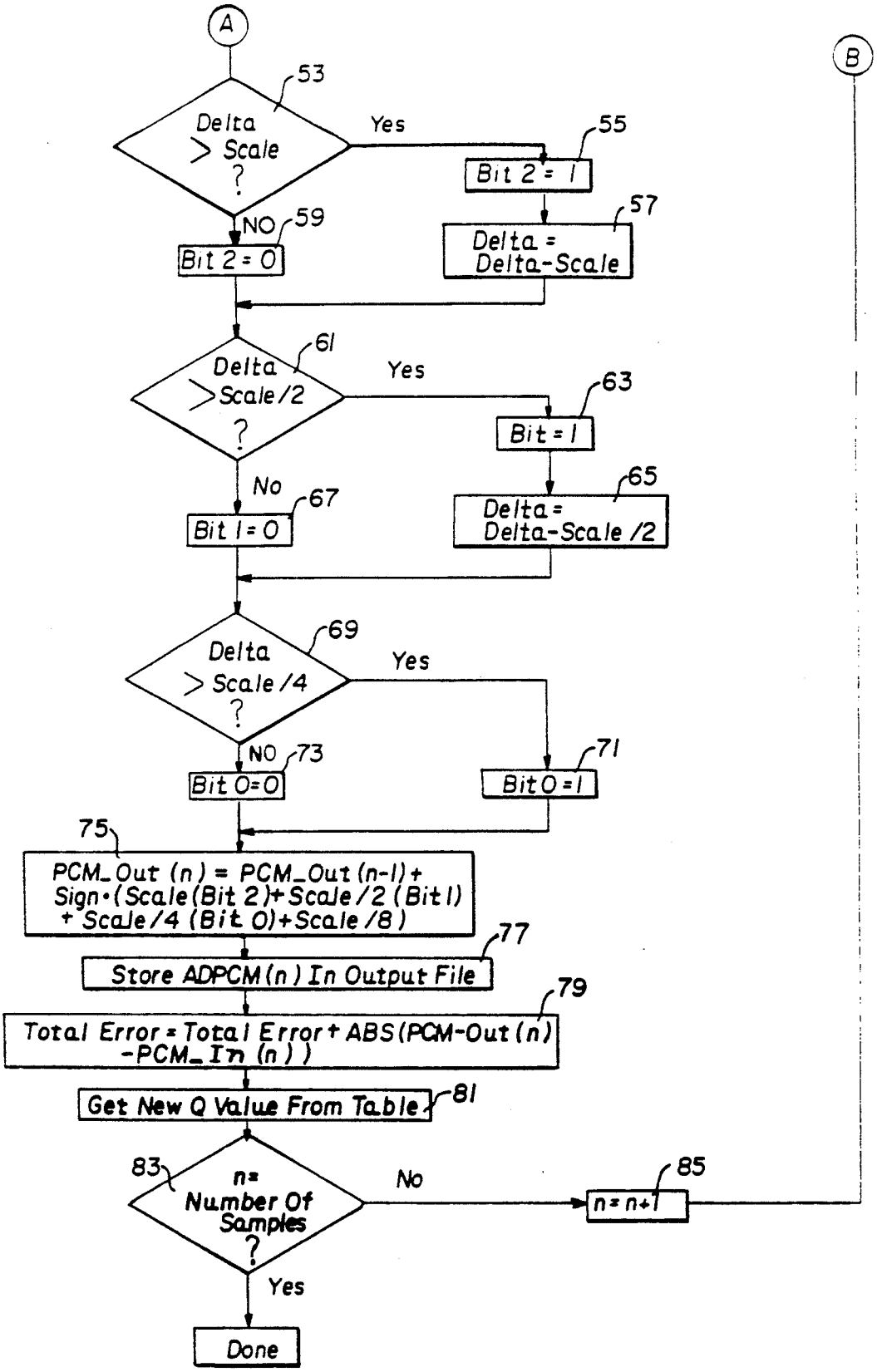

More particularly, the manner in which the compressed diphone library is prepared in accordance with the exemplary embodiment of the invention using the ADPCM technique of time domain compression of the PCM data is illustrated by the flow diagrams of FIGS. 7 and 8.

As shown in the flow diagram of FIG. 7, the initial quantization value for the extracted diphone is determined by the process identified within the box 1 and then the entire waveform for the diphone is analyzed to generate the compressed data which is stored in the diphone library. As indicated at 3, an initial value of "1" is assumed for the quantization factor and:

$$\text{scale} = 16 \times (1.1^{Q}) \qquad \text{Eq. 3}$$

where:

scale is the quantization value or step size Q is the quantization factor

A selected number of samples, in the exemplary embodiment 50, are then analyzed as indicated at 5 using the analysis routine of FIGS. 8*a* and *b*. By analysis it is meant, converting the PCM data for the first 50 samples of the diphone to ADPCM data starting with an initial quantization factor of zero for the first sample, reconstructing or "blowing back" PCM from the ADPCM data, and comparing the reconstructed PCM data with the original PCM data. A total error is generated by summing the absolute value of the difference between the original and reconstructed PCM data for each of the data samples. Following this initial analysis, a variable called MINIMUM ERROR is set equal to this total calculated error as at 7 and another variable BEST Q" is set equal to the initial quantization factor at 9.

A loop is then entered at 11 in which the assumed value of the quantization factor is indexed by 1 and an analysis is performed at 13 similar to that performed at 5. If the total error for this analysis is less than the value of MINIMUM ERROR as tested at 15, then MINIMUM ERROR is set equal to the value of the total error generated for the new assumed value of the quantization factor at 17, and "BEST Q" is set equal to this quantization factor as at 19. As indicated at 21, the loop is repeated until all 49 values of the quantization factor Q have been assumed. The final result of the loop is the identification of the best initial quantization factor at 23. This best initial quantization factor is then used to begin an analysis of the entire diphone waveform employing the analyze routine of FIGS. 8*a* and *b* as indicated at 25. This analysis generates the ADPCM code for the diphone which is stored in the diphone library along with other pertinent data to be identified below.

The flow diagram for the exemplary ADPCM analyze routine is shown in FIGS. 8*a* and *b*. As indicated at 27, Q, the quantization factor is set equal to the variable "initial quantization" which as will be recalled was the quantization factor determined for the first data sample which provided the minimum error for the reconstructed PCM data. This value of Q is stored in the output file which forms the diphone library as the quantization seed for the diphone under consideration as indicated at 29. Next a variable PCM_OUT (1), which is the 12 bit PCM value of the first data sample, is set equal to PCM_In (1) at 31. PCM_In (1) is then stored in the output file as the PCM seed for the first data sample as indicated at 33. Thus, a quantization seed, equal to the quantization factor and a PCM seed, equal to the full twelve bit PCM value, for the first data sample for the diphone is stored in an output file.

The quantization factor Q, as will be seen, is an exponent of the equation for determining the quantization value or step size. Hence, storage of Q as the seed is representative of storing the quantization value.

Since the full PCM value for the first data sample is stored, ADPCM compression begins with the second data sample, and hence, a sample index "n" is initialized to 2 at 35. In addition, the "TOTAL ERROR" variable is initialized to zero at 37, and the sign of the quantization value represented by the most significant bit, or BIT 3 of the four bit ADPCM code, is initialized to −1 at 39.

A loop is then entered at 41 in which the known ADPCM encoding procedure is carried out. In accordance with this procedure, if the value of PCM_In (n), the PCM value of the data point under analysis in greater than the calculated PCM value of the previous data sample, the sign of the ADPCM encoded signal is made equal to 1 by setting the most significant bit, BIT 3 (in the 0 to 3, 4 bit convention), equal to zero, as indicated at 43. If, however, the PCM value of the current data sample is less than the reconstructed PCM value of the previous data sample as determined at 45, the sign is made equal to minus 1 by setting the most significant bit equal to 1 at 47. If PCM_In (n) is neither greater than nor less than PCM_OUT (n−1), the sign, and therefore BIT 3, remain the same. In other words if the PCM values of the two data samples are equal, it is considered that the waveform continues to move in the same sense.

Next, delta is determined at 49 as the absolute difference between the PCM value of the data sample under consideration and the reconstructed value, PCM_OUT (n−1), of the previous data sample. SCALE (or the quantization value) is then determined at 51 as a function of Q, the quantization factor. If DELTA is greater than SCALE, as determined at 53, then the second most significant bit, BIT 2, is set equal to 1 at 55 and SCALE is subtracted from DELTA at 57. If DELTA is not greater than SCALE, the second most significant bit is set to zero at 59.

Next, DELTA is compared to one-half SCALE at 61 and if it is greater, the third most significant bit, BIT 1, is set to 1 at 63 and one-half scale (using integer division) is substracted from DELTA at 65. On the other hand, BIT 1 is set equal to zero at 67 if DELTA is not greater than one-half SCALE. In a similar manner, DELTA is compared to one-quarter SCALE at 69 and the least significant bit is set to 1 at 71 if it is greater, and to zero at 73 if it is not.

PCM_OUT (n), the reconstructed or blown back PCM value of the current sample point, is calculated at 75 by summing, with the proper sign, the sum of the products of BITS 2, 1 and 0 of the ADPCM encoded signal times SCALE. In addition, one eighth SCALE is added to the sum since it is more probable that there would be at least some change rather than no change in amplitude between data samples. The four bit ADPCM encoded signal for the current sample point is then stored in the output file at 77. Next, the total error for the diphone is calculated at 79 by adding to the running total of the error, the absolute difference between the blown back PCM value, PCM_OUT (n) and the actual PCM value, PCM_IN (n).

Finally, a new value for Q, the quantization factor, is determined at 81. Q for the next sample point is equal to the value of Q for the current sample point plus the coefficient m which is determined from Table I. As in the discussion above on the ADPCM technique, the value of m is dependent upon the ADPCM value of the previous sample point. It should be noted at this point that the formula at 51 for generating SCALE is mathematically the same as Equation 2 above for $\Delta n$, and thus $\Delta n$ and SCALE represent the same variable, the quantization value. It is evident from this that either the quantization value may be stored directly or the quantization factor from which the quantization value is readily determined may be stored as representative of the seed quantization value. In view of this, the term quantizer is used herein to refer to the quantity stored as the seed value and is to be understood to include either representation of the quantization value.

The above procedure is repeated for each of the n samples as indicated at 83, and by the feedback loop through 85 where n is indexed by 1. This analysis routine is used at three places in the program for generating the library entry for each diphone. First, at 5 in the flow diagram of FIG. 7 to analyze the initial assumed value of the quantization factor for the first sample. It is used again, repetitively, at 15 to find the best value of the quantization factor for the first sample point. Finally, it is used repetitively at 25 to ADPCM encode the remaining sample points of the diphone.

As can be appreciated from the above discussion, the complete output file which forms the diphone library includes for each diphone the quantizer seed value and the 12-bit PCM seed value for the first sample point, plus the 4-bit ADPCM code values for the remaining sample points.

Figure 9:
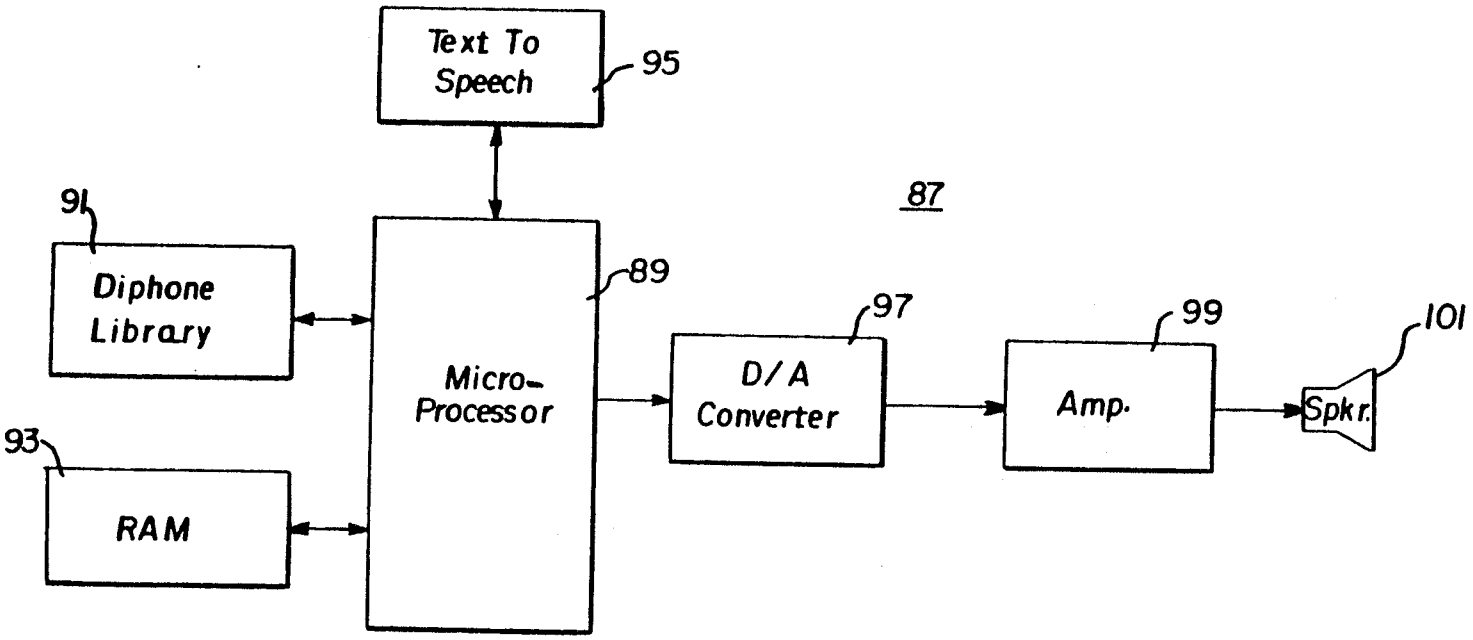
FIG. 9 is a schematic diagram of a system for generating acoustic waveforms from a selected sequence of the digitally compressed diphones.
Figure 10:
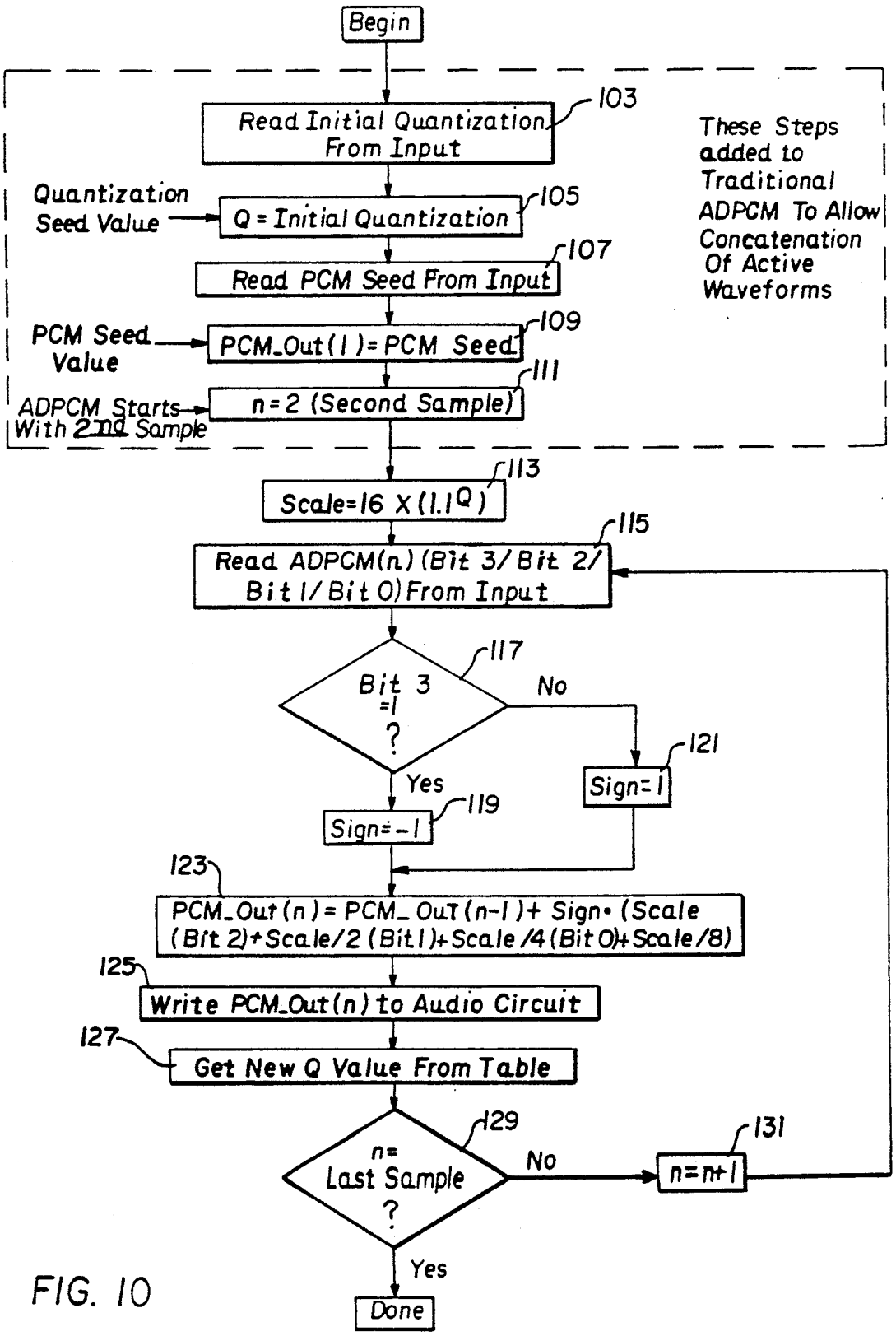
FIG. 10 is a flow diagram of a program for reconstructing and concatenating the selected sequence of digitally compressed diphones.

The system 87 for generating speech using the library of ADPCM encoded diphones sounds is disclosed in FIG. 9. The system includes a programmed digital computer such as microprocessor 89 with an associated read only memory (ROM) 91 containing the compressed diphone library, random access memory (RAM) 93 containing system variables and the sequence of diphones required to generate a desired spoken message, and text to speech chip 95 which provides the sequence of diphones to the RAM 93. The microprocessor 89 operates in accordance with the program stored in ROM 91 to recover the compressed diphone data stored in library 91 in the sequence called for by the text to speech program 95, to reconstruct or "blow back" the stored ADPCM data to PCM data, and to concatenate the PCM waveforms to produce a real time digital, speech waveform. The digital, speech waveform is converted to an analog signal in digital to analog converter 97, amplified in amplifier 99 and applied to an audio speaker 101 which generates the acoustic waveform.

A flow diagram of the program for reconstructing the PCM data from the compressed diphone data for concatenating active waveforms on the fly is illustrated in FIG. 14. The initial quantization factor which was stored in the diphone library as the quantizer is read at 103 and the variable Q is set equal to this initial quantization factor at 105. This is the quantization seed value, which is an indication of the rate of change of the beginning of the waveform of the diphone to be joined. The stored or seed PCM value of the first sample of the diphone is then read at 107 and PCM_OUT (1) is set equal to PCM seed at 109. These two seed values set the amplitude and the size of the step for ADPCM blow back at the beginning of the new diphone to be concatenated. The seed quantization factor will be the same or almost the same as the quantization factor for the end of the preceding diphone, since as discussed above, the preceding diphone will end with the same sound as the beginning of the new diphone. The PCM seed sets the initial amplitude of the new diphone waveform, and in view of the manner in which diphones are cut, will be the closest PCM value of the waveform to the zero crossing.

As discussed in connection with storing the diphones, ADPCM encoding begins with the second sample, hence the sample index, n, is set to 2 at 111. Conventional ADPCM decoding begins at 113 where the quantization value SCALE is calculated initially using the seed value for Q. The stored ADPCM data for the second data sample is then read at 115. If the most significant bit, BIT 3, as determined at 117 is equal to 1, then the sign of the PCM value is set to −1 at 119, otherwise it is set to +1 at 121. The PCM value is then calculated at 123 by adding to the reconstructed PCM value for the previous sample which in the case of sample 2 is the stored PCM value of the first data sample, the scaled contributions of BITS 2, 1 and 0 and one-eighth of SCALE. This PCM value is sent to the audio circuit through the D/A converter 97 at 125. A new value for the quantization factor Q is then generated by adding to the current value of Q the m value from Table I as discussed above in connection with the analysis of the diphone waveforms.

The decoding loop is repeated for each of the ADPCM encoded samples in the diphone as indicated at 129 by incrementing the index n as at 131. Successive diphones selected by the text to speech program are decoded in a similar manner. No extrapolation or other blending between diphones is required. A full strength signal which effects a smooth transition from the preceding diphone is achieved on the first cycle of the new diphone. The result is quality 4 KHz bandwidth speech with no noticeable bumps between the component sounds.

While specific embodiments of the invention have been described in detail, it will be appreciated by those skilled in the art that various modifications and alternatives to those details could be developed in light of the overall teachings of the disclosure. Thus, synthesized speech can be generated in accordance with the teachings of the invention using other coarticulated speech segments in addition to diphones. Accordingly, the particular arrangements disclosed are meant to be illustrative only and not limiting as to the scope of the invention which is to be given the full breadth of the appended claims and any and all equivalents thereof.

What is claimed:

1. A method of generating speech using prerecorded real speech diphones, said method comprising the steps of:

digitally recording with a bandwidth of at least 3 KHz spoken carrier syllables in which desired diphone sounds are embedded;

extracting digital data samples representing beginning, ending, and intermediate diphone sounds from the digitally recorded at least 3 KHz carrier syllables at a substantially common preselected location in the waveform of each diphone;

storing data samples representing said extracted digital diphone sounds in a digital memory device;

generating a selected text to speech sequence of diphones required to generate a desired message;

recovering stored data from said digital memory device for each diphone in said selected sequence of diphones;

concatenating said selected sequence of diphones directly without any interpolation signals, in real time, using the recovered data; and applying the concatenated diphone data to sound generating means to generate a desired message with at least a 3 KHz bandwidth.

2. The method of claim 1 including time domain compressing the data samples representing said extracted digital diphone sounds prior to storage in said digital:

a memory device, and wherein recovering said stored data includes reconstructing the diphone data from said time domain compressed data.

3. The method of claim 2 wherein said step of time domain compressing said diphone data includes generating a quantizer for each compressed data sample, wherein storing includes storing a seed quantizer for each diphone, and wherein reconstructing includes generating a quantizer for each compressed data sample from the quantizer for the preceding data sample beginning with said seed quantizer.

4. The method of claim 3 wherein storing includes storing uncompressed digital data for the first data sample in each diphone as a seed value for the diphone data, and wherein reconstructing includes using said diphone data seed value as the value for the first data sample in a reconstructed diphone and using the seed quantizer and stored compressed data for the second data sample to generate the reconstructed data value of the second data sample.

5. The method of claim 4 wherein said time domain compressing comprises adaptive differential pulse code modulation.

6. The method of claim 5 wherein generating said seed quantizer for the data samples for said diphones includes a) assuming a quantizer for the first data sample, b) time domain compressing a selected number of data samples, c) reconstructing the data samples from the compressed data, d) comparing the reconstructed compressed data with the original data, e) iteratively adjusting the value of the assumed quantizer and repeating steps b through d, and f) selecting as the seed quantizer the assumed value thereof which satisfies selected criteria of said comparison step.

7. The method of claim 6 wherein said comparison includes generating an absolute value of the difference between the reconstructed and original values of the diphone data for each data sample and summing said absolute values to generate a total error, and wherein the step of selecting comprises selecting as the seed quantizer the assumed quantizer value which produces the minimum total error.

8. The method of claim 1 wherein said diphones are extracted from the recorded carrier syllables substantially at the digital data sample closest to a zero crossing with each waveform traveling in the same direction.

9. The method of claim 8 wherein said diphone sounds are digitally recorded at a bandwidth of about 4 KHz.

10. A method of time domain compression of pulse code modulated (PCM) data samples of beginning, ending and intermediate coarticulated speech segments extracted from digitally recorded carrier syllables comprising the steps of:

assuming a quantizer for the first data sample; time domain compressing the PCM data for each of a selected number of data samples in succession as a function of a quantizer generated from the quantizer for the preceding sample starting with the assumed value of the quantizer for the first data sample;

reconstructing said PCM data from said compressed data for each of said selected number of data samples as a function of a quantizer generated from the quantizer for the preceding sample starting with the assumed value of the quantizer for the first data sample;

comparing the reconstructed data with said PCM data for said selected data samples;

iteratively repeating the above steps for selected different assumed values of said quantizer for the first data sample;

selecting as the final value of said quantizer for the first data sample the value which generates a predetermined comparison between the reconstructed data and the PCM data;

storing said final value of said quantizer for the first data sample; and time domain compressing PCM data for all data points in said coarticulated speech segment as a function of a quantizer generated from the quantizer for the preceding data sample beginning with the final assumed value of said quantizer for the first data sample.

11. The method of claim 10 wherein said step of comparing reconstructed data with the PCM data comprises generating an absolute value of the difference between the reconstructed data and PCM data for each data sample and summing said absolute values to generate a total error, and wherein the step of selecting the final value of the quantizer for the first data sample comprises selecting the assumed quantizer which produces the minimum total error.

12. The method of claim 11 wherein adaptive differential pulse code modulation is used for time domain compressing said PCM data.

13. A method of generating speech using prerecorded real speech coarticulated speech segments, said method comprising the steps of:

digitally recording as PCM (pulse code modulated) data samples spoken carrier syllables in which desired coarticulated speech segment sounds are embedded;

extracting the PCM data samples representing desired beginning, ending and intermediate coarticulated segment sounds from the digitally recorded carrier syllables at a substantially common preselected location in the waveform of each coarticulated speech segment;

digitally compressing the PCM data samples of said coarticulated speech segments using adaptive differential pulse code modulation (ADPCM) to generate ADPCM encoded data;

storing the ADPCM compressed data representing said extracted digital coarticulated speech segment sounds in a digital memory device;

generating a selected text to speech sequence of coarticulated speech segments required to generate a desired message;

recovering stored ADPCM encoded data from said digital memory device for each coarticulated speech segment in said selected sequence of coarticulated speech segments;

reconstructing the PCM coarticulated speech segment data samples from said recovered ADPCM encoded data;

concatenating said reconstructed PCM coarticulated speech segment data samples in said selected text to speech sequence of coarticulated speech segments directly without any interpolation signals, in real time;

and applying the concatenated reconstructed coarticulated speech segment data samples to sound generating means to generate said desired message.

14. The method of claim 13 wherein compressing the PCM data samples includes generating a seed quantizer for the first data sample in each coarticulated speech segment, wherein storing includes storing said seed quantizer for the first data sample, and wherein reconstructing the coarticulated speech segment data samples includes using the stored seed quantizer to initiate reconstruction of the PCM coarticulated speech segment data samples from the ADPCM encoded data.

15. The method of claim 14 wherein said storing includes storing the PCM value for the first data sample for each coarticulated speech segment as the PCM seed value together with the seed quantizer and the ADPCM encoded data, and wherein reconstructing said PCM data comprises using the stored PCM seed value as the reconstructed PCM value for the first data sample and generating the reconstructed PCM value of the second data sample as a function of the PCM seed value, the seed quantizer and the stored ADPCM encoded data for the second sample.

16. The method of claim 15 wherein said seed quantizer for the first data point in each coarticulated speech segment is iteratively determined as an assumed value which best matches the reconstructed data for a selected number of samples in the coarticulated speech segment with the PCM data for those selected samples.

17. The method of claim 16 wherein said beginning, ending and intermediate coarticulated speech segment sounds are extracted from said carrier syllables substantially at the PCM data point closest to a zero crossing of each waveform, with each waveform traveling in the same direction.

18. The method of claim 17 wherein said carrier syllables are digitally recorded with a bandwidth of at least 3 KHz.

19. Apparatus for generating speech from pulse code modulated (PCM) data samples of coarticulated speech segments extracted from the beginning, middle and end of carrier syllables digitally recorded with a bandwidth of at least 3 KHz, said apparatus comprising:

means for digitally compressing the PCM data samples, including means for adaptive differential pulse code modulation (ADPCM) encoding said PCM data samples and for generating a quantizer for the first data sample of each coarticulated speech segment;

means for storing the digitally compressed data samples, including means for storing as seed values said quantizer and said PCM data for the first data sample in each coarticulated speech segment;

means for generating a selected text to speech sequence of coarticulated speech segments required to generate a desired message;

means responsive to said means for generating said selected text to speech sequence of coarticulated speech segments for recovering the stored digitally compressed data samples for each coarticulated speech segment in said selected sequence of coarticulated speech segments, including means for recovering said seed quantizer and said seed PCM data;

means for reconstructing PCM data from said recovered compressed data in said selected sequence, including means for using said seed PCM value as the reconstructed PCM data for the first data sample and for generating the reconstructed PCM value of the second data sample as a function of the reconstructed PCM data for the first data sample, said seed quantizer, and the stored ADPCM data for the second data sample; and means responsive to said sequence of reconstructed PCM data for generating an acoustic wave containing said desired message.

20. A system for generating speech using prerecorded real speech diphones; said system comprising:

means for digitally recording with a bandwidth of at least 3 KHz spoken carrier syllables in which desired diphone sounds are embedded;

means for extracting digital data samples representing beginning, ending, and intermediate diphone sounds from the digitally recorded at least 3 KHz carrier syllables at a substantially common preselected location in the waveform of each diphone;

means for storing data samples representing said extracted digital diphone sounds;

means for generating a selected text to speech sequence of diphones required to generate a desired message;

means responsive to the means for generating said text to speech sequence of diphones for recovering from said storing means stored data for each diphone in said selected sequence of diphones;

means for concatenating said selected sequence of diphones directly without any interpolation signals, in real time, using the recovered data; and sound generating means responsive to said concatenated diphones to generate acoustic waves with at least a 3 KHz bandwidth containing said desired message.

21. The system of claim 20 including means for time domain compressing the data samples representing said extracted digital diphone sounds for storage in said storage means, and wherein said means for recovering said storage data include means for reconstructing the diphone data from said time domain compressed data.

22. The system of claim 21 wherein said means for time domain compressing data samples comprises means for adaptive differential pulse code modulation (ADPCM) encoding of such data samples and include means for generating a seed quantizer for the first data sample in each diphone, wherein said storing means includes means for storing said seed quantizer, and wherein said means for reconstructing said PCM data included means for utilizing said seed quantizer to reconstruct the first ADPCM encoded sample.

23. The system of claim 22 wherein said means for generating said seed quantizer includes means for assuming a value for said seed quantizer, means for ADPCM encoding a selected number of data samples starting with said assumed seed quantizer value, means for reconstructing the selected number of data samples from the compressed data beginning with the assumed quantizer value, means for comparing the reconstructed compressed data with the PCM data, means for iteratively adjusting the assumed value of the seed quantizer and means for selecting as the seed quantizer the assumed value thereof which satisfies selected criteria of said comparison means.

* * * * *

UNITED STATES PATENT AND TRADEMARK OFFICE

CERTIFICATE OF CORRECTION

PATENT NO. : 5,153,913

DATED : October 6, 1992

INVENTOR(S) : EDWARD M. KANDEFER ET AL.

It is certified that error appears in the above-identified patent and that said Letters Patent is hereby corrected as shown below:

On the Title Page, the Assignee should read --Sound ntertainment, Inc. (Assignee of interest of James osenfelder)--.

Column 8, line 38, "are" should be --were--.

Column 9, line 9, --data-- should be inserted after PCM".

Signed and Sealed this

Twenty-eighth Day of September, 1993

Bruce Lehman

*Attest:*

BRUCE LEHMAN

*Attesting Officer*

*Commissioner of Patents and Trademarks*